US005660438A

United States Patent [19]

Tedesco

[11] Patent Number: 5,660,438

[45] Date of Patent: Aug. 26, 1997

[54] CHAIR HAVING ERGONOMIC LUMBAR SUPPORT CUSHION

[75] Inventor: Romeo Tedesco, Ontario, Canada

[73] Assignee: Global Upholstery Company Inc., Downsview, Canada

[21] Appl. No.: 569,964

[22] Filed: Dec. 8, 1995

[30] Foreign Application Priority Data

Mar. 17, 1995 [CA] Canada ..... 2144903

[51] Int. Cl.[6] ..... A47C 4/54

[52] U.S. Cl. ..... 297/284.6; 297/284.1; 297/284.8; 297/452.41

[58] Field of Search ..... 297/284.6, 284.8, 297/284.1, 452.41, DIG. 3, DIG. 1, 463.1

[56] References Cited

U.S. PATENT DOCUMENTS

| | | | |
|---|---|---|---|
| 3,652,126 | 3/1972 | Folling | 297/284.6 |
| 3,661,422 | 5/1972 | Sember et al. | 297/284.6 |
| 3,770,315 | 11/1973 | Smittle et al. | 297/284.6 |
| 3,770,401 | 11/1973 | Sheets, Jr. et al. . | |
| 4,190,286 | 2/1980 | Bentley | 297/DIG. 3 X |
| 4,444,430 | 4/1984 | Yoshida et al. | 297/284.6 |
| 4,491,364 | 1/1985 | Hattori et al. | 297/294.6 |
| 4,570,676 | 2/1986 | Nishio et al. | 297/284.6 X |
| 4,832,401 | 5/1989 | Brooks | 297/284.1 |
| 4,890,885 | 1/1990 | Grossmann | 297/284.1 |
| 4,914,766 | 4/1990 | Moore | 5/432 |
| 5,033,133 | 7/1991 | Nissen | 5/450 |
| 5,076,643 | 12/1991 | Colasanti et al. | 297/284.6 |
| 5,137,329 | 8/1992 | Neale | 297/284.6 |
| 5,152,579 | 10/1992 | Bishai | 297/284.6 |
| 5,190,348 | 3/1993 | Colasanti et al. | 297/284.6 |

FOREIGN PATENT DOCUMENTS

| | | | |
|---|---|---|---|
| 45438 | 3/1985 | Japan | 297/284.6 |
| 425730 | 9/1935 | United Kingdom | 297/284.6 |

OTHER PUBLICATIONS

Global Brochure—Jun. 15, 1994.

*Primary Examiner*—Peter M. Cuomo
*Assistant Examiner*—Rodney B. White
*Attorney, Agent, or Firm*—Bereskin & Parr

[57] ABSTRACT

A lumbar support includes a pocket within the chair back and a lumbar cushion, of a particular cross-sectional shape is completely disposed within that pocket and sited approximately complementary to a person's lumbar region. The lumbar cushion includes a unitary, open-cell, elastically-resilient cushion of foam, the cushion of foam being fixed within a flexible, air-impermeable envelope. The foam has an air inlet/outlet conduit directly leading thereinto, and an opening extending through the flexible, air-impermeable envelope. A valve structure in the inlet/outlet tube is provided for controlling gas pressure within the cushion of foam for adjusting the firmness of the lumbar support means in the chair in a position accessible to a chair occupant. The valve structure includes a guide tube secured to the opening in the air inlet/outlet conduit. An air-impermeable plug, is manually-slidable within the guide tube between an open position, allowing flow of air, and a resiliently-biased closed position stopping flow of air. A manually-actuatable member is disposed within the tubular member and is secured to the air-impermeable plug for moving the air-impermeable plug between the two positions. An outer flange forming part of the guide tube is secured by its side face to a side of the chair back.

7 Claims, 3 Drawing Sheets

FIG. 1.
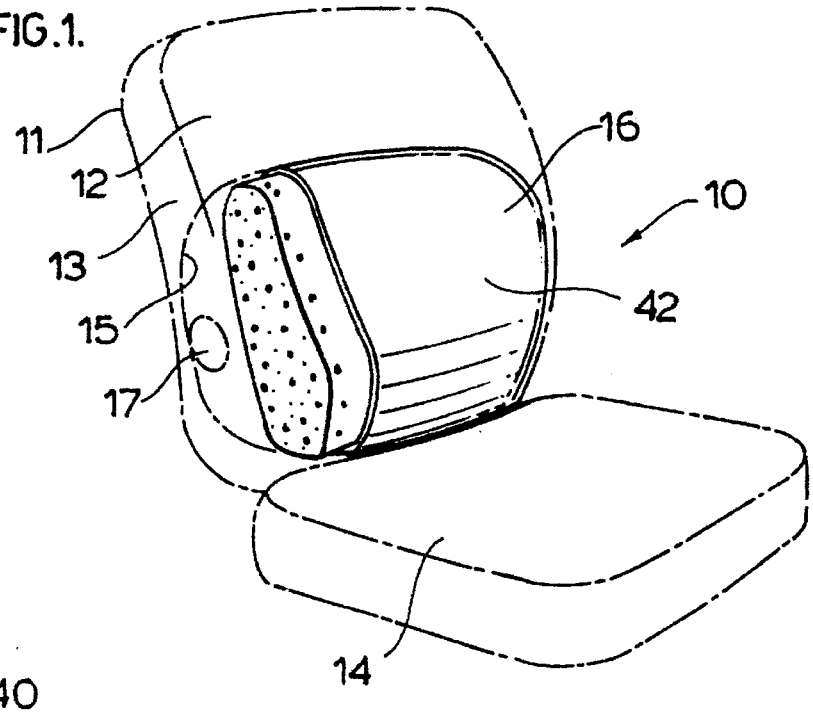
FIG. 2.
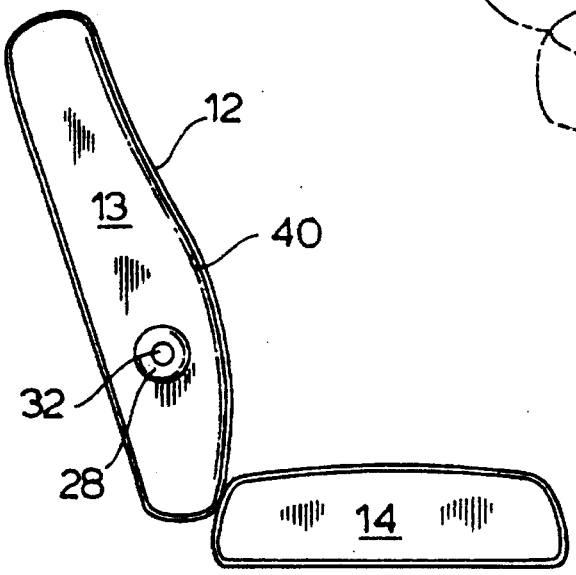
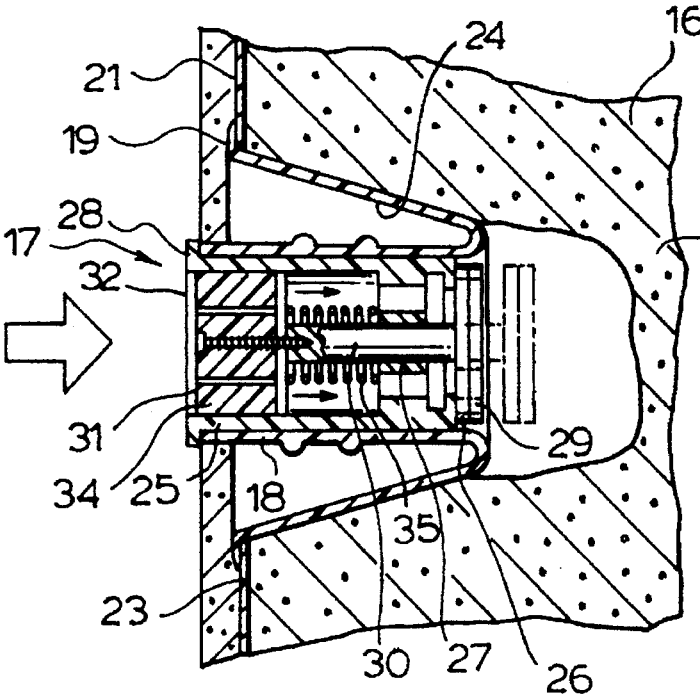
FIG. 3.

CHAIR HAVING ERGONOMIC LUMBAR SUPPORT CUSHION

BACKGROUND OF THE INVENTION

1. Field of the Invention

This invention relates to a chair having an ergonomic lumbar support air cushion therein in which the amount of air can be manually controlled so that a personalized amount of back support can be achieved and retained and yet is easily adjusted.

2. Description of the Prior Art

It is recognized that no one seat back shape or contour is ideal for all persons who will be occupying the seat and, as a result, it is of advantage to provide means for adjusting the seat back contour. Notably, the provision for the adjustment of a lumbar section in the seat back is very desirable. As a result, special support cushions have been developed for the lower portion of the back. Such lumbar support cushions, provided in the past, are both weight responsive and manually adjustable.

In one form of such adjustable lumbar cushion, an open-cell foam material is provided in an air-tight envelope. A push button form of manually-controllable valve is used in an air passageway to the interior of the envelope and the foam. Thus, where the cushion thickness is greater than desired by the seat occupant, the seat occupant can push his back against the cushion zone while at the same time opening the valve to let air out of the open-cell foam encased within the envelope. When the cushion has the right lesser thickness or feel, the occupant can close the valve and maintain a vacuum in the cushion envelope. On the other hand, if the occupant wishes to let the lumbar cushion have a greater thickness or a fuller support, the occupant can temporarily lean forward and take his back weight or pressure from the cushion while opening the valve so as to let the vacuum of the open-cell foam pull in ambient air. Nevertheless, problems of operation of the valve which was essential for the effective changing of the contour of such cushion necessitated improvements therein.

Accordingly, U.S. Pat. No. 3,652,126 patented Mar. 28, 1972 by N. D. Folling provided a pneumatic form of seat back panel adjustment system for a seating unit. Such seating unit included an air-tight seat envelope traversing a portion of the seat area of the seating unit. An open-cell foam filler having internal springiness and resilience was included to provide self-inflation and air storage therein. A movable seat back panel section traversed a portion of the back of the seating unit. An expansible-contractible bladder having a substantially smaller internal volume than the seat envelope was positioned in combination with the movable seat back panel section and was included to provide outward and return movements for such section. A conduit connected the bladder with the seat envelope. A manually-operative valve was provided in the conduit to permit air flow between the seat envelope and the bladder. An air inlet included a check valve connected to the interior of the seat envelope to the open-cell foam. Ambient air automatically flowed into the open-cell foam when there was no occupant weight thereon to replenish air transferred to the bladder.

U.S. Pat. No. 3,661,422 patented May 9, 1972 by J. Sember et al provided a valve for a weight responsive support cushion unit that was adapted for supporting a particular portion of the human body, where open-cell foam cushion material was maintained in an air-tight envelope. An ambient air passageway was provided to the envelope and a manually-controllable valve means was connected to the passageway to regulate the flow of ambient air pressure into and out of the envelope. The valve included a body member with an air-inlet-outlet to the interior thereof. A manually movable plug member included movement means connected thereto to permit air flow into and out from that body member through the inlet-outlet. A separate small area bleed-in orifice was provided to the interior of the valve body. A separate displaceable orifice covering was provided for the interior face of the bleed-in orifice. A vacuum condition in the envelope provided for an inward ambient air flow through the bleed-in orifice and the passageway. Conversely, a weight pressure on the envelope provided a back pressure and seating of the covering means over the orifice.

U.S. Pat. No. 3,770,315 patented Nov. 6, 1973 by D. C. Smittle et al provided an adjustable lumbar support for a chair having a seat portion and a resilient adjustable chair back. That lumbar support included a cavity in the chair back opposite the lumbar region of a chair occupant. The lumbar support was positioned in the cavity for engaging a chair occupant's lumbar region. The lumbar support included a flexible, impermeable envelope having one face in the cavity and the other face approximately complementary to a person's lumbar region. An open cell, elastically-resilient body of foam was situated in the envelope, the body of foam extending forwardly from the cavity beyond the adjacent chair back. Means were provided for controlling gas pressure within the envelope for adjusting the firmness of the lumbar support means. The control means were mounted on the chair in a position accessible to a chair occupant.

U.S. Pat. No. 4,832,401 patented May 23, 1989 by V. L. Brooks provided a lumbar support which had means for its connection with a femur seat cushion of a seat. The femur seat cushion was deflectable with respect to the seat cushion frame of the seat. The lumbar support was also slidably and resiliently mounted to the seat back. The location of the lumbar support with respect to the seat back was a function of the deflection of the femur seat cushion with respect to the seat cushion frame. Therefore, the lumbar support exhibited a tendency to be closer to the optimum position in relationship to seat occupant's back regardless of the seat occupant's weight.

U.S. Pat. No. 4,890,885 patented Jan. 2, 1990 by K. Grossman provided a seating arrangement including a seat, a backrest including a backrest frame and an integrated headrest. A vacuum cushion was arranged at the backrest within the area of the headrest. The vacuum cushion included a cover of air non-permeable material, and a large number of small plastic material parts arranged inside of the cover. An extraction pump and at least one valve were provided for individually matching the vacuum cushion to the physiological cervical spinal column-lordosis of the seat user.

U.S. Pat. No. 5,033,133 patented Jul. 23, 1991 by G. P. Nissen provided a seat cushion having an inner core of a compressible material having an open cellular structure filled with air when uncompressed. Compression of the material expelled air from that structure. The inner core had an uncompressed size and shape complementary to the seat cushion. An inner cover enclosed the inner core material, the inner cover being of an air-tight material and being sealed, thus hermetically sealing an inner space thereof including the inner core from the atmosphere. The inner cover was of a size larger than the uncompressed size of the inner core and fitted loosely about the inner core. An outer cover enclosed the inner core and inner cover and was of a size which was smaller than the size of the inner cover. The inner cover was movably disposed between the core and the outer cover. The size and shape of the outer cover defined the outer dimensions of the seat cushion. A conduit extended through the inner cover and the outer cover and communicated at one end with the interior space of the inner cover and at the other end with the atmosphere. Finally a valve was disposed in the conduit, the valve selectively opening and closing the communication between the interior of the inner cover and the atmosphere. The valve was operable by a person sitting on the cushion.

U.S. Pat. No. 5,137,329 patented Aug. 11, 1992 by G. G. Neale provided a user adjustable lumbar support for inclusion in a seat back. The support included rigid back plate having front and rear surfaces and which was adapted to extend vertically within a seat back. A front plate was included having a front and back surface and having an orthotic lumbar support contour at its front surface. A multi-chambered fluid actuator was provided including at least a pair of independently-inflatable chambers arranged vertically one chamber above the other. Means were provided to support the actuator and the front plate in assembled relationship to the back plate with the chambers between the plates. The supporting means were elastic to accommodate relative motion between the plates as the chambers were inflated and deflated. Means were provided for admitting and venting fluid under pressure separately to and from each of the chambers for selectively inflating and deflating the chambers to alter the positional relationship of the front plate to the back plate, so that the lumbar support contour can be adjusted by a person using the seat back to a position giving optimum lumbar support at a desired elevation along the seat back. Finally, resilient means were provided for supporting the back plate about a vertical axis of the seat back to allow compliant rotational motion of the support assembly within the seat back in response to like motion of the torso of a person seated against the seat back.

Portable cushions have also been provided to be usable in combination with existing seating. One such patented cushion is provided by U.S. Pat. No. 4,914,766 patented Apr. 10, 1990 by B. S. Moore. The patented pneumatic cushion included a bladder. Means were provided within the bladder which formed a plurality of hermetically-sealed cells. A charging valve was provided for admitting a pneumatic charge to one of the cells. A contour control valve was provided in another of the cells. Pneumatic communication means connected the control valve with each of the cells. The control valve had a first position for interconnecting the cells and a second position for pneumatically isolating the cells.

A commercially-available adjustable back cushion has been provided by Microcomputer Accessories Inc. That cushion was alleged to be able to be temporarily secured to the backrest of a chair. The cushion was said to be able to inflate or deflate the cushion to the natural contours of the back of the user.

SUMMARY OF THE INVENTION

Aims of the Invention

Yet none of the chairs and/or cushions discussed above made use of a particularly-shaped, self-inflating foam member, in combination with a special manually-controllable valve to permit a seat occupant to adjust the degree of back support by changing the contour of the back cushion, while maintaining that adjustment permanently set, until re-adjusted by the user.

Statement of Invention

By the present invention, then, an improvement is provided in a chair including a seat portion, and a chair back. The improvement comprises a lumbar support in the chair back for engaging a chair occupant's lumbar region. The lumbar support includes a pocket within the chair back and a lumbar cushion completely disposed within that pocket and sited approximately complementary to a person's lumbar region. The lumbar cushion includes a unitary, open-cell, elastically-resilient cushion of foam, the cushion of foam being fixed within a flexible, air-impermeable envelope. The cushion has a back portion which is shaped to be complementary to the front face of the pocket within the chair back, and a frontal portion having a generally arcuate face, so that the cushion has a generally air-foil cross-section. The foam has an air inlet/outlet conduit directly leading thereinto, and an opening extending through the flexible, air-impermeable envelope. A valve structure is provided for controlling gas pressure within the cushion of foam for adjusting the firmness of the lumbar support means in the chair in a position accessible to a chair occupant. The valve structure includes a guide tube secured to the opening in the air inlet/outlet conduit. An air-impermeable plug, is manually-slidable within the guide tube between an open position, allowing flow of air, and a resiliently-biased closed position stopping flow of air. A manually-actuatable member is disposed within the guide tube and is secured to the air-impermeable plug for moving the air-impermeable plug between the two positions. An outer flange forming part of the guide tube is secured by its side face to a side of the chair back.

Other Features of the Invention

By one feature of such valve member, the internal end of the guide tube has a fixed closed end wall, provided with a central bore therethrough, the other, outer end of the guide tube being provided with a manually-movable end wall, the air-impermeable plug being a seating plug which includes a fixed, outwardly-projecting pin which extends through the bore in the fixed closed end wall, and is fixed to the manually-movable end wall, and a coil spring held captive on the pin between the manually movable end wall and the fixed closed end wall.

By another feature thereof, the manually-movable end wall comprises a button in the shape of a hollow cylinder, the button being adapted to slide within the guide tube, and being resiliently biased along with the air-impermeable plug, to its outer position by the spring.

By yet another feature thereof, the cushion of foam occupies substantially the entire interior volume of the envelope.

By still another feature thereof, the cushion of foam comprises an open cell polyurethane foam, and by yet another variant thereof, the cushion material is a low density polyurethane foam.

By another feature thereof, the outer cover is formed of a vinyl impregnated nylon material, and by another feature thereof, the air impermeable envelope includes an inner cover which is formed of thin sheet polyethylene material, and an outer cover which is of a relatively thicker material, thereby providing an outer protective cover of durable material enclosing the inner cover.

BRIEF DESCRIPTION OF THE DRAWINGS

In the accompanying drawings,

FIG. 1 is a perspective, partially cut-away view of the adjustable lumbar support chair of the present invention;

FIG. 2 is a side elevational view of the chair of FIG. 1;

FIG. 3 is a central longitudinal cross-section of the adjustable lumbar cushion showing the valve in more detail, the valve forming an essential component of the adjustable lumbar support chair of the present invention.

DESCRIPTION OF PREFERRED EMBODIMENTS

Description of FIGS. 1 & 2

Figure 4:
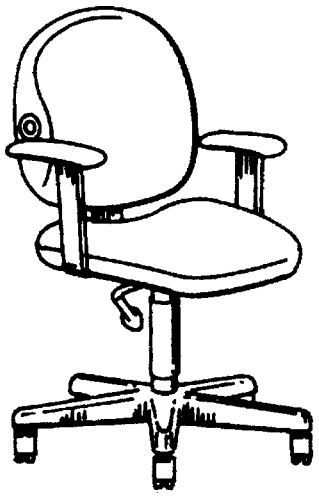
FIG. 4 to 14 are perspective view of other versions of the adjustable lumbar support chairs of the present invention.

As seen in FIG. 1 and FIG. 2, the chair 10 includes a back 11 provided with a back rest portion 12, side portions 13 (only one of which being shown) and a seat 14. Disposed within an internal pocket 15 in the interior of the back 11 is a self inflatable, adjustable, lumbar cushion 16 provided with a valve 17 to control an air inlet/outlet conduit 18. The external end of the conduit 18 is provided with an annular ring 19 by means of which it is secured to a side portion of the lumbar cushion 16.

Description of FIG. 3

A preferred embodiment of the lumbar cushion 16 will now be described with reference to FIG. 3. Such lumbar cushion 16 includes a resilient, springy, unitary, solid foam 20, e.g., open-cell polyurethane foam or open-cell latex foam rubber. An air-tight envelope 21 encases the foam 20. The envelope 21 may be made of polyvinyl or other synthetic, plastic material which is suitable to retain a low super-atmospheric pressure of air. The outer envelope 21 may, alternatively, consist of a relatively-thin layer of closed-cell foam material which will not permit air travel from one cell to another and will serve to hold air within the internal open-cell material.

The air-tight envelope 21 is adapted to encase the internal, resilient, open-cell foam 20, which is capable of being self-filled from ambient air. The envelope 21, as noted above, is an air-fight material and generally comprises a flexible vinyl material, a thin, closed-cell foam, or a fabric having a plastic or rubber-type of lining which is capable of holding low super atmospheric pressure of air.

Air inlet/outlet conduit 18 is secured to a side of the lumbar cushion 16, e.g., at 23. Conduit 18 enters directly into the foam 20 at 24. Valve 17 is provided to control the air inlet/outlet through the passageway provided by air inlet/outlet conduit 18 directly into, and from, the interior of the open-cell foam material 20.

The air inlet/outlet conduit 18 is fitted with a guide tube 25. The internal end of guide tube 25 is provided with an integral solid end wall 26, having a central bore 27 therethrough. The other, outer end of guide tube 25 is provided with an attachment flange 28.

Beyond the downstream end of end wall 26 is a seating plug 29. Seating plug 29 includes a fixed, outwardly-projecting pin 30 which extends through bore 27 and extends to an outer manually-movable end wall 31, which may be in the shape of a hollow cylinder. End wall 31 includes hub 34, to which the outer end of pin 30 is secured. A coil spring 35 is held captive between walls 31 and 26. Hollow cylinder 32 is therefore adapted to slide within guide tube 25, and is resiliently-biased to its outer position by spring 35.

A button 32 which is concentric with annular ring 19 enables manual control of the valve 17. Air thus is caused to flow by virtue of pressure on the foam 20 through the air inlet/outlet conduit 18, and valve 17 either to exhaust air from, or to permit flow of air into, the foam 20.

The adjustable lumbar support cushion 16 forming an essential element of this invention is placed under the outer upholstery fabric 40 of chair back 11 and as noted hereinabove, includes its own air-tight envelope 21 which encases the resilient open-cell foam 20.

The lumbar support cushion 16 has a front surface 42 facing the forward part of the chair 10 that is approximately complementary to the middle lumbar region of a person's back, that is, opposite the fourth through sixth lumbar vertebrae. Thus, when an occupant is seated in the chair, the back of the occupant is in engagement with most of the back 11 of the chair 10 and is supported thereby over much of its area.

Description of FIGS. 4 to 14

FIGS. 4 to 16 show various desirable features of chairs of embodiment of this invention. In FIG. 4 the steno chair has pneumatic height adjustment and the lumber adjustment system with air valve for adjustable lumbar support, steel uprights with upholstered armcaps, three-way back adjustment, back vinyl bumper guard, contoured upholstery, and five-legged, injection moulded base.

Figure 5:
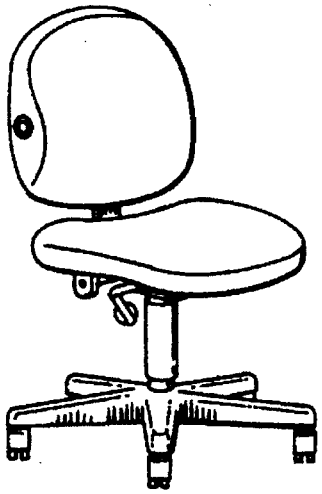

In FIG. 5 the steno posture chair has pneumatic height adjustment and the lumber adjustment system with air valve for adjustable lumbar support, two-way back adjustment, back vinyl bumper guard, contoured upholstery, and five-legged, injection molded base.

Figure 6:
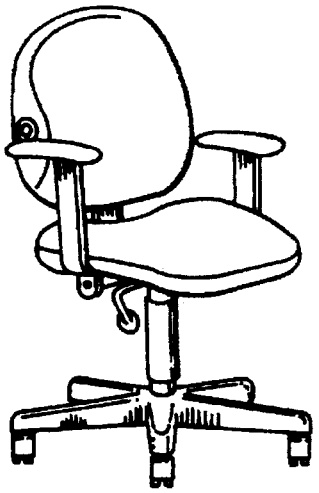

In FIG. 6, the steno posture chair has pneumatic height adjustment and the lumbar adjustment system with air valve for adjustable lumbar support, steel uprights with upholstered armcaps, three-way back adjustment, back vinyl bumper guard, contoured upholstery, and five-legged injection molded base.

Figure 7:
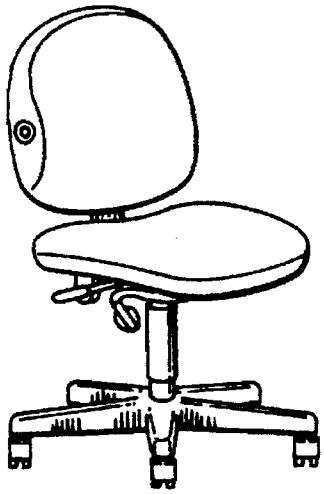

In FIG. 7, the operator chair has pneumatic height adjustment, and the lumbar adjustment system with air valve for adjustable lumbar support. Tilt forward seat, seat and back angle adjustment, back vinyl bumper guard, contoured upholstery, and five-legged, injection molded base.

Figure 8:
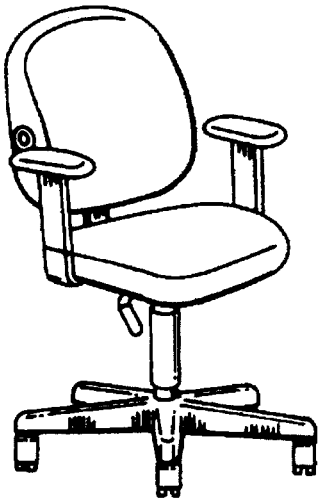

In FIG. 8, the steno chair has pneumatic height adjustment, and the lumbar adjustment system with air valve for adjustable lumbar support. Height adjustable "T" arms with upholstered armcaps. Three-way back adjustments, backrest bumper guard, contoured seat and back, and five-legged injection molded base.

Figure 9:
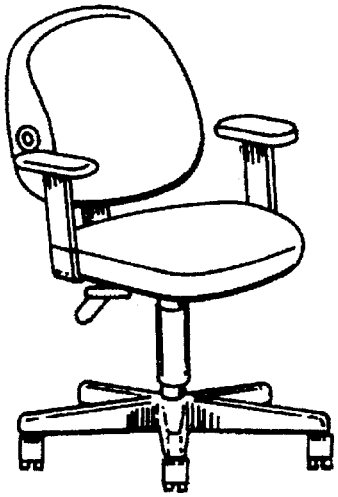

In FIG. 9, the operator chair has pneumatic height adjustment, and the lumbar adjustment system with air valve for adjustable lumbar support. Height adjustable "T" arms with upholstered armcaps. Back height adjustment, back and seat angle adjustment, backrest bumper guard, contoured seat and back, and five-legged injection molded base.

Figure 10:
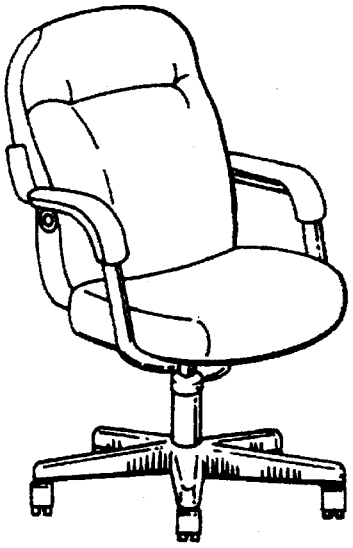

In FIG. 10, the high back tilter chair has manual height adjustment, and the lumbar adjustment system with air valve for adjustable lumbar support. Oval tube frame with upholstered armcaps, contoured seat and compound curved back, and five-legged injection molded base.

Figure 11:
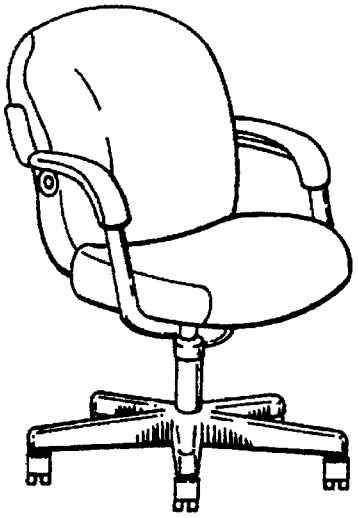

In FIG. 11, the low back filter chair has manual height adjustment, and the lumbar adjustment system with air valve for adjustable lumbar support. Upholstered armcaps, oval tube frame, contoured seat and compound curved back, and five-legged injection molded base.

Figure 12:
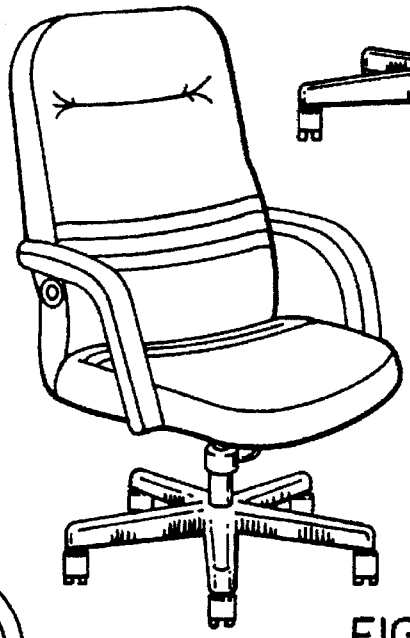

In FIG. 12, the high back filter chair has manual height adjustment, and the lumbar adjustment system with air valve for adjustable lumbar support. Wrapped arms, detailed stitching on seat and back, and five-legged injection molded base.

Figure 13:
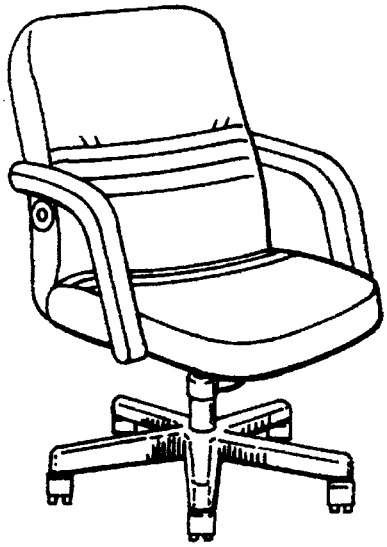

In FIG. 13, the low back filter chair has manual height adjustment, and the lumbar adjustment system with air valve for adjustable lumbar support. Wrapped arms, detailed stitching on seat and back, and five-legged injection molded base.

Figure 14:
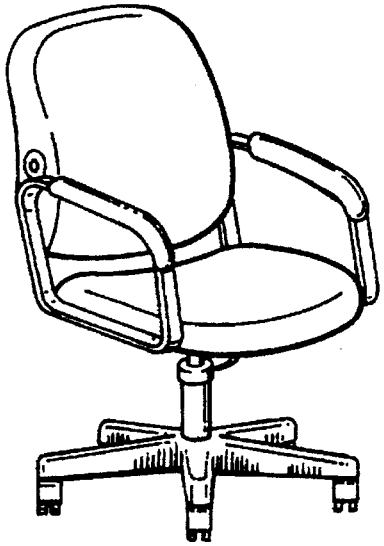

In FIG. 14, the high back tilter chair has manual height adjustment, and the lumbar adjustment system with air valve for adjustable lumbar support. Oval tube frame with self-skinned urethane armcaps, and five-legged injection molded base.

Operation of the Invention

The shape of the body of foam 20, important for the successful operation of this invention and is such that its front surface is approximately complementary to the lumbar region of a person who may occupy the seat. Since the seat may be occupied by person of substantially different shapes and sizes, the shape and contour of the body of foam can be made, according to this invention, to conform to that of an approximately average individual.

As noted hereinbefore, foam 20 is an open cell material, that is, one having fluid communication between the gas bubbles within the plastic matrix as distinguished from a closed cell foam wherein the individual cells are sealed and gas cannot flow within the foam. The foam 20 is also elastically resilient and sufficiently soft to provide good comfort for the back of a person when the person is in an erect position. It is found that a suitable foam material comprises a polyurethane foam having a density of about 1.8 pounds per cubic foot. It will be apparent to one skilled in the art that many other elastic, open cell foam materials are readily commercially available and have suitable properties for use in the lumbar support cushion 16.

The valve 17 permits ambient air to flow to the interior of the open cell foam, thereby assuring that the pressure within the open cells of the foam is substantially the same as ambient pressure. When the chair is occupied, the force of a person's back against the front face of the bag compresses the air within the inelastic bag as the elastic foam is deformed. The displaced air from the collapsed foam subject to the greatest force by the person's back flows to the regions not contacted by the person's back. In the adjustable lumbar support of the present invention, the support of the person's back is a combination of the force exerted by the differential air pressure across the wall of the envelope by the elastic resilience of the foam and the air pressure within the foam.

Thus, the chair of the present invention has a cellular foam cushion encased in heavy vinyl for extra durability. The adjustable lumbar support system enables the shape of the chair back to conform to the natural curve of the user's back, providing optimal comfort.

There are two simple steps for operation.

1) To increase lumbar support, the chair occupant leans forward while seated and press the air valve inward. The back support system will automatically fill with air. When the desired support is reached, the air valve is released.
2) To decrease the lumbar support, the air valve is depressed while the occupant leans back into the chair. When the desired support is achieved, the air valve is released.

The chair back will maintain its shape until the air valve is activated again.

Thus, a personalized amount of back support can be achieved and easily adjusted through the day. This minimizes fatigue and maximizes comfort and productivity. At the touch of a fingertip, specific levels of lumbar support can be selected through the plastic air valve that controls the air flow in and out of the lumbar cushion.

Conclusion

From the foregoing description, one skilled in the art can easily ascertain the essential characteristics of this invention, and without departing from the spirit and scope thereof, can make various changes and modifications to the invention to adapt it to various usages and conditions. Consequently, such changes and modifications are properly, equitably, and "intended" to be, within the full range of equivalence of the following claims.

I claim:

1. A chair back for use with a chair comprising:

(a) a lumbar support portion positioned to engage a chair occupant's lumbar region, said lumbar support portion having a pocket with a front face;

(b) a lumbar cushion completely disposed within said pocket and situated approximately complementary to a chair occupant's lumbar region, said cushion including
  (i) a unitary, open-cell elastically-resilient cushion of foam positioned within a flexible, air-impermeable envelope,
  (ii) an air inlet/outlet conduit leading into said foam through .an opening in said envelope;
  (iii) a valve structure for controlling gas pressure within said foam for adjusting firmness of Said lumbar support in the chair and accessible to a chair occupant, said valve structure including
    (1) guide tube secured to said opening in said air inlet/outlet conduit;
    (2) an air impermeable plug manually slidable within said guide tube between an open position allowing flow of air and a resiliently biased closed position stopping flow of air;
    (3) a manually actuable member disposed within said guide tube and secured to said plug for moving said plug between said open and closed positions;
    (4) an outer flange forming part of said guide tube secured by its face to a side of said chair back;
    (5) a fixed, closed inner end wall having a central bore therethrough;
    (6) a manually-moveable outer end wall, said plug being disposed downstream of said fixed inner end wall and including a fixed, outwardly-projecting pin which extends through said bore and is fixed to said manually-moveable outer wall; and
    (7) a coil spring positioned between said outer end wall and said inner end wall.

2. The chair back of claim 1 wherein said manually-movable end ,wall comprises a button in the shape of a hollow cylinder, the button being adapted to slide within said guide tube, and being resiliently biased, along with the air-impermeable plug, to its outer position by said spring.

3. The chair back of claim 1 wherein said cushion of foam occupies substantially the entire interior volume of said envelope.

4. The chair back of claim 1 wherein said cushion of foam comprises an open cell polyurethane foam.

5. The chair back of claim 1 wherein said cushion of foam comprises an open cell low density polyurethane foam.

6. The chair back of claim 1 including an inner cover which is formed of thin sheet polyethylene material, and an outer cover which is of a relatively thicker material, thereby providing an outer protective cover of durable material enclosing said inner cover.

7. The chair of claim 1 wherein said outer cover is of a vinyl impregnated nylon material.

* * * * *